United States Patent [19]

Matsuoka et al.

[11] 4,330,111

[45] May 18, 1982

[54] MULTI-PURPOSE IN-LINE DIRECT HEAT TREATING EQUIPMENT FOR HOT ROLLED STEEL WIRE ROD

[75] Inventors: Kyoichiro Matsuoka; Nobuyasu Irie; Satoshi Inoue, all of Hikari; Katsuto Ito, Yamaguchi; Isao Yata, Hikari, all of Japan

[73] Assignee: Nippon Steel Corporation, Tokyo, Japan

[21] Appl. No.: 192,837

[22] Filed: Oct. 1, 1980

[30] Foreign Application Priority Data

Oct. 16, 1979 [JP] Japan ..... 54-133215

[51] Int. Cl.[3] ..... C21D 9/56

[52] U.S. Cl. ..... 266/106; 266/107; 198/583; 148/153

[58] Field of Search ..... 266/106, 107, 112; 198/574, 583, 586, 780; 148/153; 422/307

[56] References Cited

U.S. PATENT DOCUMENTS

| | | | |
|---|---|---|---|
| 3,154,442 | 10/1964 | Nye et al. | 266/106 |
| 4,015,706 | 4/1977 | Goffredo et al. | 198/780 |
| 4,056,186 | 11/1977 | Hill | 198/583 X |
| 4,066,477 | 1/1978 | Böckenhoff et al. | 266/120 |
| 4,242,153 | 12/1980 | Vitelli et al. | 266/106 X |

*Primary Examiner*—G. O. Peters

*Attorney, Agent, or Firm*—Wenderoth, Lind & Ponack

[57] ABSTRACT

Multi-purpose in-line direct heat treating equipment for hot-rolled steel wire rod has, in combination, a front stage transport conveyor portion and a holding furnace both positioned on a front traveling skid carriage, a quenching tank and a holding tank both positioned on a rear traveling skid carriage, each of the traveling skid carriages being able to travel in direction transverse to the direction of conveying of the hot-rolled steel wire rod emerging from a hot rolling mill for the purpose of direct heat treating the wire rod by taking advantage of the heat retained in the wire rod.

4 Claims, 6 Drawing Figures

MULTI-PURPOSE IN-LINE DIRECT HEAT TREATING EQUIPMENT FOR HOT ROLLED STEEL WIRE ROD

BACKGROUND OF THE INVENTION

A. Field of the Invention

The present invention relates to improvements in equipment for direct heat treating a hot rolled steel wire rod by taking advantage of the heat retained in the rod from the hot rolling, and more particularly, to multi-purpose in-line direct heat treating equipment for hot-rolled steel wire rod wherein wire rod the quality of which is equal to that of conventional lead-patented or air-patented wire rod can be manufactured in a stable and assured manner, and a direct solution treatment can also be conducted on an austenitic stainless steel wire rod.

B. Description of the Prior Art

A conventional high carbon steel wire rod produced by hot rolling has heretofore been subjected to air-patenting (referred to as AP hereinafter) and leat-patenting (referred to as LP hereinafter) prior to cold working, such as wire drawing, with a view to enhancing drawability, strength and toughness. Recently, there has been carried out a direct heat treatment (referred to as DP hereinafter) in which heat retained in the wire rod from the hot rolling is fully utilized. However, while various methods of DP heretofore conducted or proposed can manufacture a wire rod the quality of which is almost equal to that resulting from AP, as a matter of fact, the quality has not reached the level where a rod the quality of which is equal to that resulting from LP can be obtained.

Miscellaneous methods for heat treating the wire rod in the course of cooling immediately after the hot rolling have frequently been effected, and miscellaneous equipment for carrying out these methods is also widely known. For instance, Japan Patent Publication No. SHO 46-6690 (1971) discloses a method and apparatus for cooling non-concentric opened coils or rings of wire rod, and Japan Open-laid Patent No. SHO 52-111810 (1977) discloses an apparatus for carrying out controlled cooling of wire, particularly, steel wire.

However, in the widely adopted conventional methods of the above type, the most prevalent cooling process is the process of air-cooling the wire rod the coils or rings of which have been opened as wide as possible. In this method of cooling, however, the range of cooling capacity is so narrow that both uniformity and rapidity of cooling required for a high carbon steel wire rod are not achieved, and hence this type of cooling process results in inadequate cooling. Recently, wire rod has tended to have high tensile strength and a large diameter, and particularly where uniform quality of wire rod is in much demand, the effect of heat treatment by means of air-patenting is not fully achieved because the air-cooling method lacks cooling capacity. Furthermore, in air-cooling, of stainless steel wire rod, a solution treatment cannot be carried out because the temperature of the start of cooling is low and the cooling rate is slow.

SUMMARY OF THE INVENTION

It is a principal object of the present invention to provide multi-purpose in-line direct heat treating equipment wherein miscellaneous methods of heat treatment required for any grade or size of hot rolled steel wire rod can be carried out.

It is another object of the invention to provide heat treating equipment for a hot rolled high carbon steel wire rod of high tensile strength by a combination of equipment comprising direct air-patenting equipment utilizing heat retained in the hot rolled wire rod from the hot rolling to which is added a holding furnace and a salt bath means.

It is still another object of the invention to provide combined heat treating equipment comprising direct air-patenting equipment to which is added equipment in which an austenitic stainless steel wire rod is subjected to a solution treatment.

BRIEF DESCRIPTION OF THE DRAWINGS

Other and further objects of the invention will be understood from the following detailed description taken together with the accompanying drawings, in which.

DETAILED DESCRIPTION OF THE INVENTION

The multi-purpose in-line direct heat treating equipment of this invention comprises a transport conveyor means on which a continuous coil of wire rod with the rings of the coil non-concentric and overlapping emerging from a hot rolling mill travels continuously in the direction from inlet to the outlet and wherein the conveyor is divided in the traveling direction thereof into an inlet end conveyor, a front stage conveyor, a rear stage conveyor, and an outlet end conveyor, these sections being separate from one another, the front stage conveyor and an adjoining holding furnace being side by side on a front traveling skid carriage, the rear stage conveyor and a quenching tank and a holding tank side by side on a rear traveling skid carriage in the traveling direction from the front skid carriage, and a cooling and washing apparatus above and below the outlet end conveyor, and each skid carriage being movable transversely to the traveling direction.

Figure 1:
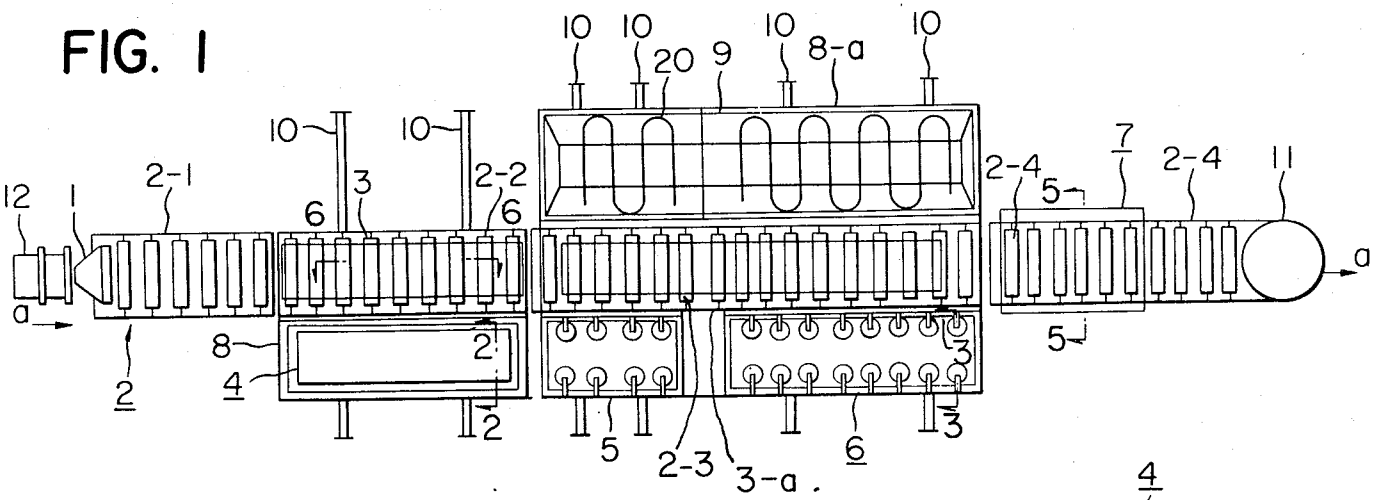
FIG. 1 is a top plan view of the equipment of this invention.

Referring more particularly to FIG. 1, the equipment of this invention is provided with a laying head 12 which receives a hot rolled wire rod emerging from the final finishing stand of a hot rolling mill, and with a reeler 1 directly connected to the head 12. A transport conveyor means 2 travels from the reeler 1 to a collection tub 11 shown at the right of FIG. 1 and in the direction from left to right in the direction of arrows a-a. The transport conveyor 2 of this invention is divided into an inlet end conveyor 2-1, a front stage conveyor 2—2, a rear stage conveyor 2-3, and an outlet end conveyor 2-4, and a holding furnace 4 is provided adjacent to and on one side of the front stage conveyor 2—2. An air-cooling apparatus 3 is provided under the front stage conveyor 2—2, and the apparatus 3 together with the holding furnace 4 are on a front traveling skid carriage 8. The front traveling skid carriage 8 travels on the rails 10 in a direction nransverse to the direction of transport of the wire rod S. The skid carriage 8 can be shifted so as to make it possible selectively use either the holding furnace 4 or the air-cooling apparatus 3, the shifting being carried out by means of driving apparatus and a fixed position stopping apparatus (neither are shown in the drawing).

A quenching tank 5 and a holding means 6 are arranged along one skide of the rear stage 2-3. An air-cooling apparatus **3-*a* is provided under the rear stage conveyor 2-3. The rear stage conveyor 2-3 provided with the air-cooling apparatus 3-*a* is mounted on skid carriage 8-*a* which in turn is mounted on the rails 10 for movement in a direction transverse to the direction of movement of the rear stage conveyor 2-3. The rear traveling skid carriage 8-*a* also carries the holding means 6 and the quenching tank 5. If required, a thermal cover 9 may be put on the rear stage conveyor 2-3. As shown in FIG. 1, the rear traveling skid carriage 8-*a* is positioned downstream in the direction of transport of the wire rod from the front traveling skid carriage 8, and the carriage 8-*a* includes a driving apparatus and a fixed position stop apparatus (not shown) within it. Further, the carriage 8-*a* can selectively use the thermal cover 9 and can selectively position either the air-cooling apparatus 3-*a* or the quenching tank 5 and the holding means 6 in line with the inlet and outlet end conveyors. In addition, a cooling and washing apparatus 7 is provided above and below the outlet end conveyor 2–4, and the apparatus is connected to the collection tub 11**.

Figure 2:
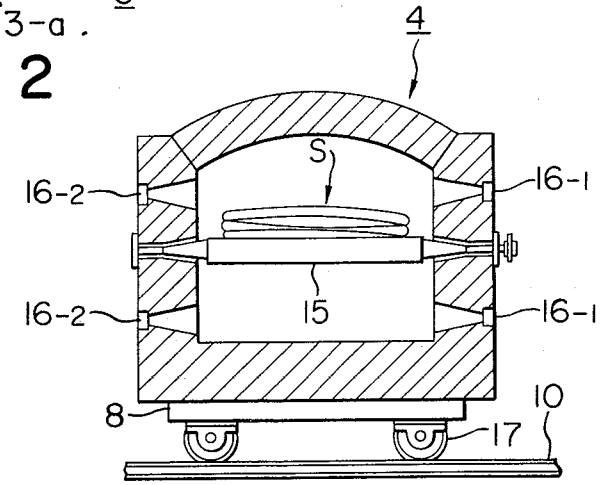
FIG. 2 is a section taken along the line 2—2 of FIG. 1.

FIG. 2 is a front sectional view of the holding furnace 4 positioned on the front traveling skid carriage 8, and it can travel along the rails 10 on the wheels 7. Transport rollers 15 are provided within the holding furnace 4, and a plurality of burners 16-1 and 16-2, as many as desired, are installed in both walls. The wire rod to be treated is shown at S.

Figure 3:
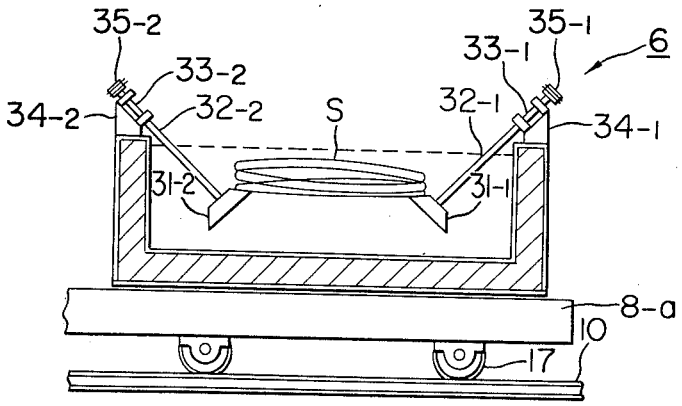
FIG. 3 is a section taken along the line 3—3 of FIG. 1.
Figure 4:
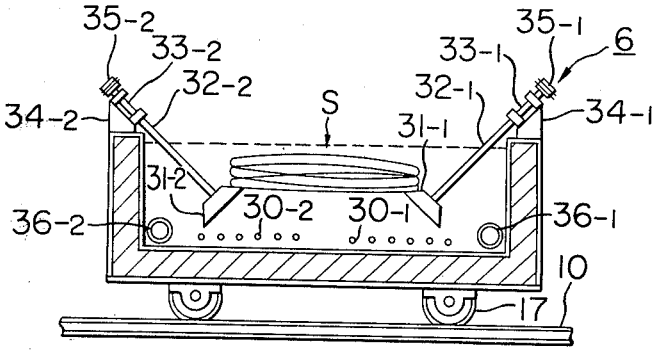
FIG. 4 is a sectional view of another embodiment of the structure of FIG. 3.

FIG. 3 is a sectional view of the quenching tank 5 and the holding means 6. They are placed on the rear traveling skid carriage **8-*a*, and they move along the rails 10 on their wheels 17. Driving means 35-1 and 35-2 are provided on the pedestals 34-1 and 34-2 mounted on shafts 32-1 and 32-2 in bearings 33-1 and 33-2. The wire rod is supported on the rollers 31-1 and 31-2. Each tank is filled with a liquid, such as molten salt. The liquid in the tank is stirred as required by mechanical or gas-blasting means such as gas pipes 30-1 and 30-2 shown in the embodiment of FIG. 4. If needed, the liquid in the quenching tank 5 may be cooled or heated and the liquid in the holding means is heated by heating means such as pipes 36-1 and 36-2 for heating or cooling as shown in the embodiment of FIG. 4**.

Figure 5:
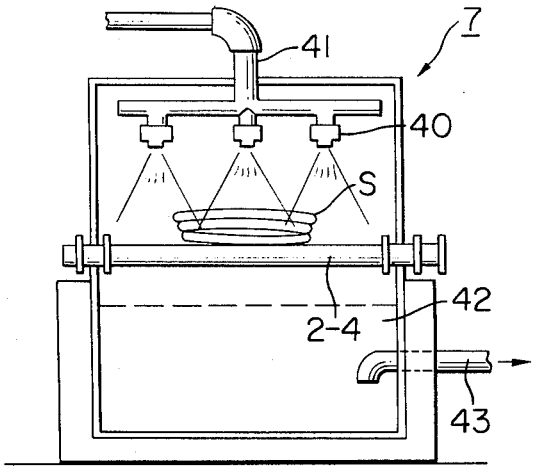
FIG. 5 is a section taken along the line 5—5 of FIG. 1.

FIG. 5 is a sectional view of the cooling and washing apparatus 7, which is provided above and below the outlet end conveyor 2-4 downstream of the rear traveling skid carriage. Above the conveyor 2-4 are provided a plurality of water pipes having jet nozzles 40 thereon, the number being as desired. As the non-concentric overlapping convolutions of the wire rod S are being transported by the outlet end conveyor 2–4, water is blasted onto rod S from jet nozzles 40 in order to cool and wash rod S. In addition, the water after having cooled and washed the rod is collected in a drain tank 42 below the transport rollers and drained therefrom by a drain-pipe 43.

Figure 6:
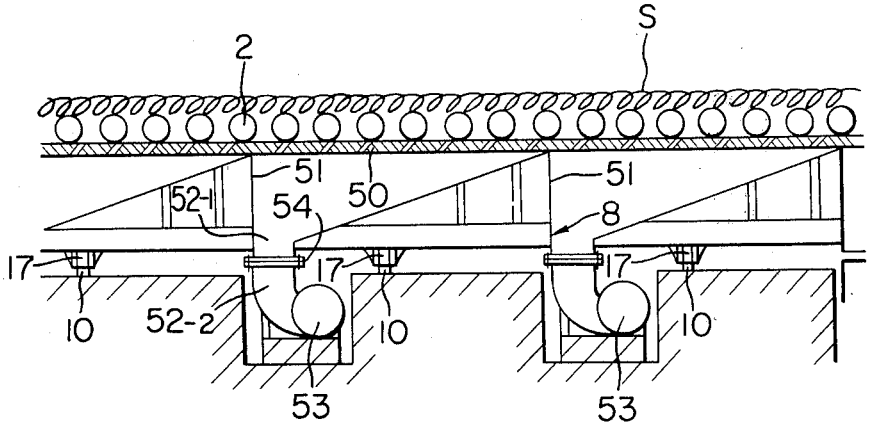
FIG. 6 is a section taken along the line 6—6 of FIG. 1.

FIG. 6 is a side view of the air-cooling apparatus positioned under the front stage conveyor 2—2 and the rear stage conveyor 2-3 wherein the convolutions of the wire rod S transported on the transport conveyor means 2 are cooled by cold air blown by air nozzles 50 from a distributing box 51 which distributes the cold air to the nozzles 50 uniformly. Blowers 53 are mounted in fixed positions below and separate from the skid carriage 8.

When the skid carriage moves to position the air-cooling apparatus 3 in line with the conveyor means 2, ducts 52 on the distributing box 51 are connected at joints 54-1 to corresponding ducts 52-2 on the blowers.

The operation and effect of the above described equipment will now be described in connection with the following examples.

A high carbon steel wire rod made of a grade of steel which requires no high tensile strength, but having relatively little cold workability is selected and subjected to direct air patenting (referred to as DAP hereinafter). Next, another high carbon steel wire rod which requires high tensile strength together with a relatively high cold workability is subjected to direct patenting (referred to as DLP hereinafter) by which a wire rod the quality of which is equal to that of one subjected to lead patenting can be obtained. Further, austenitic stainless steel wire rod is subjected to solution treatment (referred to as DST hereinafter).

The operation of the parts of the equipment of this invention for carrying out the above heat treating steps is selectively carried out as follows:

For carrying out DAP, the arrangement of the parts is as shown in FIG. 1, and the jet nozzles 40 of the cooling and washing apparatus 7 are shut off and the wire rod S is passed along the conveyor means 2 in the direction of arrows a. The wire rod S formed in non-concentric overlapping rings by the reeler 1 is deposited on the inlet end conveyor 2-1 and the non-concentric rings of the wire rod S are transported on the conveyor. The wire rod S is cooled by the air-cooling apparatus 3 on the front stage conveyor 2-2 and also by the air-cooling apparatus 3-a on the rear stage conveyor 2-3 while it is being transported on the conveyor. Thus, the wire rod S emerging from the air-cooling apparatus **3-*a* is deposited on the outlet end conveyor 2-4, and finally, it is collected in coil form by the collecting tub 11**.

For carrying out DLP, respective traveling skid carriages 8 and 8-a shown in FIG. 1 are transferred to move the holding furnace 4, quenching tank 5 and holding means 6 into line with the inlet and outlet end conveyors 1, 2-1 and 2-4, and in this state the convolutions of the wir rod S are conveyed along the conveyor through the holding furnace 4, the quenching tank 5 and the holding means 6 in order from left to right in FIG. 1. In other words, the wire rod S formed by the reeler 1 into the non-concentric overlapping rings is deposited on the inlet end conveyor 2-1, transported on the conveyor, again deposited on the transport rollers 15 of the holding furnace 4, held at a specified temperature for a period of specified time while being transported through the holding furnace, subsequently led into the quenching tank 5 to be cooled by the cooling liquid in the tank at a specified temperature for a period of specified time while being transported through the holding furnace, subsequently led into the quenching tank 5 to be cooled by the cooling liquid in the tank at a specified cooling rate to a cooling temperature, thereafter led into the holding means where it is held by a liquid therein at a specified temperature for a specified period of time, then introduced into the cooling and washing apparatus 7 where the liquid on the surface of the wire rod is removed by water blasted from the jet nozzles 40 provided above and below while being transported, and finally the wire rod S is collected by the collecting tub 11 in coiled form.

For carrying out DST, only the front traveling skid carriage 8 in FIG. 1 is transferred to move the holding furnace into line with the conveyor in FIG. 1 and the air nozzles 50 of the air-cooling apparatus 3-a are closed. The wire rod S formed by the reeler 1 into non-concentric overlapping rings is deposited on the inlet end conveyor 2-1, transported on the conveyor, held at a specified temperature for a specified period of time while being passed through the holding furnace 4, quenched by the water blown from the jet nozzles 40 provided in the cooling and washing apparatus 7, and subsequently collected in the collection tub 11. In addition, if necessary, the wire rod S on the rear stage conveyor 2-3 can be tightly enclosed by thermal cover 9 during treatment.

The wire rod transport means in the quenching tank 5 and the holding tank 6 in accordance with the present invention, is the conic rollers 31 in the embodiment shown in FIGS. 3–4. The reason for the use of the conic rollers is as follows: The roll bearing and driving means of the conic roller 31 will not be damaged by oxidizing and corrosion, an anti-leak seal for liquid is not required because the shafts do not penetrate the side wall of the liquid tank, the life of the equipment is long, and the whole construction is almost maintenance-free. However, the transport means is not to be limited to the above embodiment, and a transport means such as a chain conveyor or roller conveyor may be used.

As fully described in the foregoing, the present invention is directed to in-line direct heat treatment equipment wherein almost all sizes and all grades of steel wire rod produced by a hot rolling line can be subjected to various heat treatment processes in accordance with the conditions needed to achieve the optimum product quality. Moreover, as is usual with conventional equipment, enormous equipment for every cooling system is no longer required, and multi-purpose miscellaneous heat treatment methods can be conducted in compact equipment wherein the reeler and the collecting apparatus can be utilized for all wire rods. Accordingly the present invention has a superior industrial advantage.

The following Table 1 shows the results of the results of the treatment of wire rods the quality of which has been improved by heat treatment by the equipment of this invention.

TABLE 1

| Steel Grade | Heat Treating Apparatus | Working Step ( ) heat treating step | Rod Diameter (mm) | TS (kg/cm$^2$) | Hv ( ) reduction of area |
|---|---|---|---|---|---|
| SWR H82B | Invention Apparatus | As rolled → (DLP) → pickle → wire drawing | 5.5ϕ | 137 | (45%) |
| | Conventional Apparatus | As rolled → (LP) → pickle → wire drawing | 5.5ϕ | 132 | (44%) |
| SUS 304 | Invention Apparatus | As rolled → (DST) → pickle → wire drawing | 5.5ϕ | 57 | 140 |
| | Conventional Apparatus | As rolled → (reheating solution treatment) → pickle → wire drawing | 5.5ϕ | 57 | 140 |

As clearly shown in Table 1, the effect of heat treatment which is almost equal to that conducted heretofore in an off-line process can be obtained by the use of this invention, and the quality of the wire rod manufactured by the process and equipment of this invention can match that produced by conventional equipment.

Although the present invention has been described and diagrammatically illustrated in connection with the preferred embodiments, it is to be understood that modifications may be resorted to without departing from the spirit of the invention. Such modifications are considered to be within the scope of the present invention as defined by the appended claims.

We claim:

1. Multi-purposed in-line direct heat treating equipment for heat treating a hot-rolled steel wire rod, which equipment comprises, in combination:

an inlet end conveyor for receiving wire rod emerging from a hot rolling mill in the form of a continuous coil of non-concentric overlapping rings;

a front traveling skid carriage adjacent the downstream end of said inlet and conveyor;

a front stage conveyor on said front traveling skid carriage and extending in the same direction as said inlet end conveyor;

a holding furnace on said front traveling skid carriage side-by-side with said front stage conveyor, said front traveling skid carriage being movable transversely of the direction in which said inlet end conveyor transports the wire rod for aligning either the front stage conveyor or the holding furnace with said inlet end conveyor;

a rear traveling skid carriage adjacent the downstream end of said front traveling skid carriage;

a rear stage conveyor on said rear traveling skid carriage and extending in the same direction as said inlet end conveyor;

a quenching tank and a holding tank on said rear traveling skid carriage and positioned one behind the other and side-by-side with said rear stage conveyor, said rear traveling skid carriage being movable transversely of the direction in which said inlet end conveyor transports the wire rod for aligning either the rear stage conveyor or the quenching tank and the holding tank with said inlet end conveyor;

an outlet end conveyor adjacent the downstream end of said rear traveling skid carriage and aligned with said inlet end conveyor; and a cooling and washing apparatus above and below said outlet end conveyor.

2. Multi-purpose in-line direct heat treating equipment as claimed in claim 1 in which both said quenching tank and said holding tank are tanks for containing molten salt, and said equipment further comprising a stirrer means in each of said tanks for stirring molten salt.

3. Multi-purpose in-line direct heat treating equipment as claimed in claim 2 further comprising temperature control means in both said quenching tank and said holding tank for controlling the temperature of molten salt.

4. Multi-purpose in-line direct heat treating equipment as claimed in claim 1 further comprising a thermal cover on said rear traveling skid conveyor and movable between a position in which it covers said rear stage conveyor and a position in which it is away from said rear stage conveyor to leave said rear stage conveyor uncovered.

* * * * *